United States Patent [19]

Ferri

[11] Patent Number: 5,058,303

[45] Date of Patent: Oct. 22, 1991

[54] TOY FIRE-ARM FOR STRIP AMMUNITION

[76] Inventor: Giampiero Ferri, Via Vecchia Fiesolana No. 74, Frazione S. Domenico, Fiesole, Firenze, Italy

[21] Appl. No.: 569,826

[22] Filed: Aug. 20, 1990

[30] Foreign Application Priority Data

Aug. 30, 1989 [IT] Italy ..... 11680/89[U]

[51] Int. Cl.[5] ..... F41C 3/12

[52] U.S. Cl. ..... 42/57

[58] Field of Search ..... 42/57

[56] References Cited

U.S. PATENT DOCUMENTS

| | | | |
|---|---|---|---|
| 3,362,097 | 1/1968 | Ferri et al. | 42/57 |
| 4,890,404 | 1/1990 | Ferri | 42/57 |

FOREIGN PATENT DOCUMENTS

| | | | |
|---|---|---|---|
| 3141929 | 5/1983 | Fed. Rep. of Germany | 42/57 |
| 3400222 | 7/1985 | Fed. Rep. of Germany | 42/57 |
| 2089665 | 6/1982 | United Kingdom | 42/57 |

*Primary Examiner*—Charles T. Jordan

*Attorney, Agent, or Firm*—Hopgood, Calimafde, Kalil, Blaustein & Judlowe

[57] ABSTRACT

A toy fire-arm is disclosed comprising a hollow, butt-shaped handle connected to a trigger and barrel assembly, including percussion means for firing strip ammunition fed thereto. The handle has a seat for receiving and supporting a magazine therein. The magazine is insertable in the handle against the seat. The magazine includes means for supporting strip ammunition (S) arranged side-by-side also means for maintaining the plurality of strps (S) against one side of the magazine to enable the sequential feeding of each of the strips from the magazine to and through strip guide means to the trigger and barrel assembly. A slider means is also provided disposed along said one side of the magazine for slidingly feed strip ammunition containing firing charges C1 from the magazine in steps through the guide means to the trigger and firing assembly for firing by the percussion means.

6 Claims, 2 Drawing Sheets

TOY FIRE-ARM FOR STRIP AMMUNITION

The invention refers to a toy fire-arm comprising a large "butt"-shaped handle. The fire-arm makes use of charges carried by strip shaped, that is to say tape-developed cartridges. For their use in the arm of the present invention, the strips are held inside a magazine with feeding slider and are inserted one-by-one by said slider into the feeding and percussion device which comprises part of said arm. In order to achieve a more convenient distribution of the overall dimensions, and to meet the market requirements concerning aesthetic and design, according to the invention, it is provided that the magazine-receiving seat be placed within said handle said handle being hollow, and that strips-sliding guides be provided which have a curved development from the handle to the front part or barrel of the toy arm.

The projection for the manual actuation of the slider may be made to slide along the handle. More particularly, the slider with its projection lies along the rear part of the handle, and the projection juts out rearwardly of the handle.

The slider has a straight guide part, which slides within straight guides of the magazine and of the arm, and pushes the strip along the straight guide of the magazine to feed it to the curved guides of the arm.

Within the magazine a spring pusher may be provided, which urges the strips, placed close to each other, towards the slider to make them slide one after the other by means of the slider. Said pusher is elastically urged.

The drawing shows a feasible embodiment of the invention and, in particular:

Figure 4:
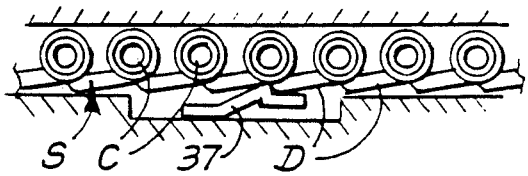
FIG. 4 shows a detail of the strip ammunition-feeding device.

According to what is illustrated in the attached drawing, 1 generally indicates the case of the toy fire-arm which is shaped like a true arm (a common pistol in the drawing). The case has a relatively large part 1A which forms the handle, which connects to a trigger and barrel assembly as shown in the drawing that is to say the handle of the fire-arm is butt-shaped. The numeral 1B indicates the trigger guard for the trigger 3. The case forming the fire-arm is practically constructed with two substantially symmetrical and coupled half-shells which house the feeding and release device or firing in the barrel, generally indicated by the numberal 5 and of a known per se type, which operates on the strip ammunition S (see FIG. 4) for the percussion of the firing charges. The strip is provided, along one edge, with a tooth D having the same pitch as the firing charges C in the strip S. The firing charges are received in bow-shaped seats of the strip. Generally stated, the feeding and release or firing device 5, which is operated by the trigger 3, has a percussion-pin 51 pivotally engaged to a pin 52 fixed within case 1, and urged by a coil spring 53 reacting between said pin and a pawl provided on the same case. The trigger 3 is engaged to a pin 54 which is capable of sliding within an elongated hole 31 of the trigger 3. The trigger is urged by a spring 33 in counter-clockwise direction and rests on a pawl 55 of the case 1. The trigger 3 has a rearwardly extending tooth 35 cooperating with a tooth 57 of the percussion member 51. The trigger 3 is further provided with an elastic appendix 37 acting laterally on the toothing D to cause the strip ammunition S to advance by one pitch at a time in the direction of arrow fS each time the trigger is operated in the direction of arrow f3. By this movement, the tooth 35, acting on tooth 57, rotates the percussion member 51 about the pin 52 in counter-clockwise direction against the action of the spring 53 until the tooth 35 disengages from the tooth 57, so that the percussion member 51 is released and trips against the cartridge or firing charge C1 which is in the position where it is struck by the percussion member 51. During the movement of the trigger in the direction of arrow f3, the elastic appendix 37 moves the strip S one pitch forward in the direction of arrow fS, each time carrying a fresh cartridge with firing charge to the percussion position C1.

The strip ammunition is guided into a sliding seat which is defined by ridges 1E, 1F formed by the half-shells of the case 1 and by an intermediate ridge 1G, to delimit the sliding seat for the strip ammunition with a minimum of side clearance. The sliding guide defined by the ridges 1E, 1F, 1G extends towards the front end of the arm to cause the strip to come out from an opening 1H.

The butt with the handle 1A forms a seat 7 developed along said handle and opened at the bottom, that is to say at the end of the handle, to receive the magazine 9. This magazine has a large cavity to receive a plurality of strips S1, S2, . . . Sn, which are disposed in a side-by-side relationship and which can be inserted through a slot 9A which is at the inner end of the same magazine when the magazine is inserted into the butt 1A. The magazine 9 protrudes slightly from the butt to allow for its removal. It can be retained within its seat 7 by an elastic tooth 9B solid to the housing of the magazine and that can be snap engaged into a recess of seat 7 and disengaged therefrom by a pressure on the elastic lamina 9C which forms said elastic tooth 9B. Along the rear wall of the butt or handle 1A there is formed an elongated slot 11 leasing to the housing, that is to say to the seat 7 of the magazine 9. Correspondingly, the magazine 9 is provided, along its rear edge when inserted, with a sliding seat 9E for a slider 13 that can be made to slide manually in the direction of arrow f13 by means of a lateral projection 13A extending through the slot 11 and able to slide along said slot.

Figure 1:
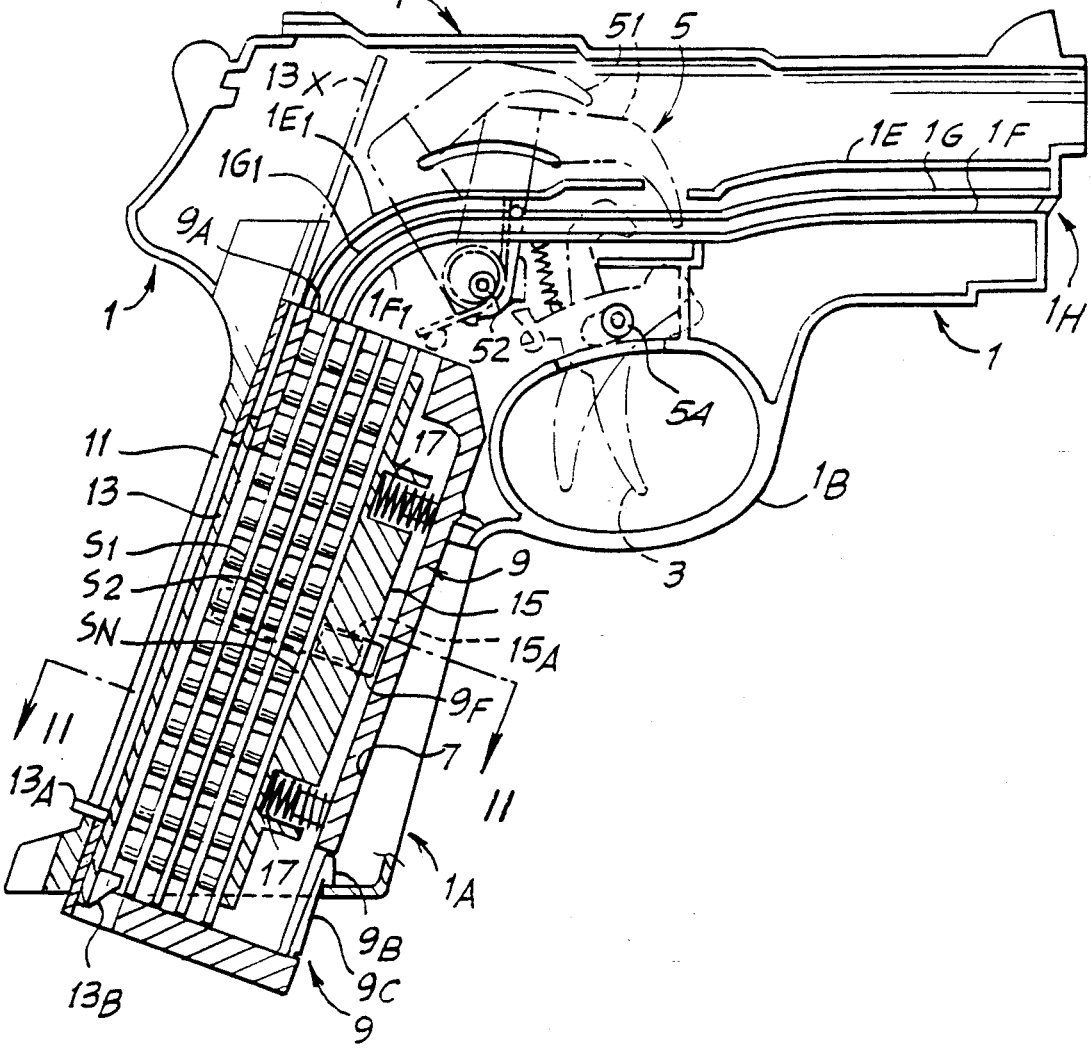
FIG. 1 shows an ensemble, including a partly sectioned side view.
Figure 2:
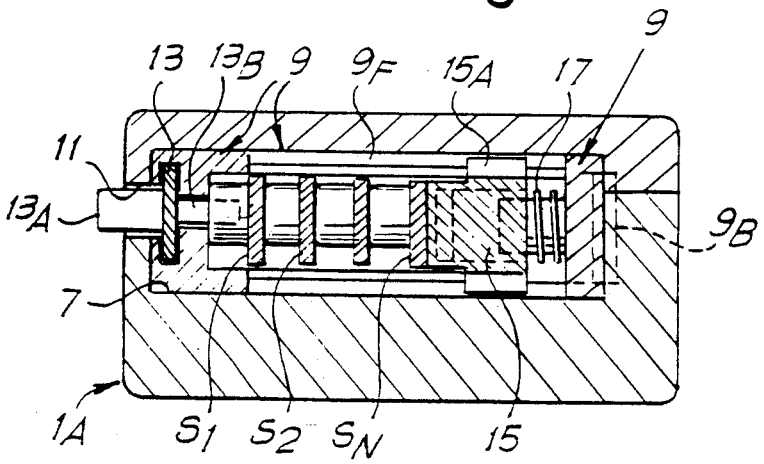
FIG. 2 shows an enlarged local section taken on line II—II of FIGS. 1 and 3.
Figure 3:
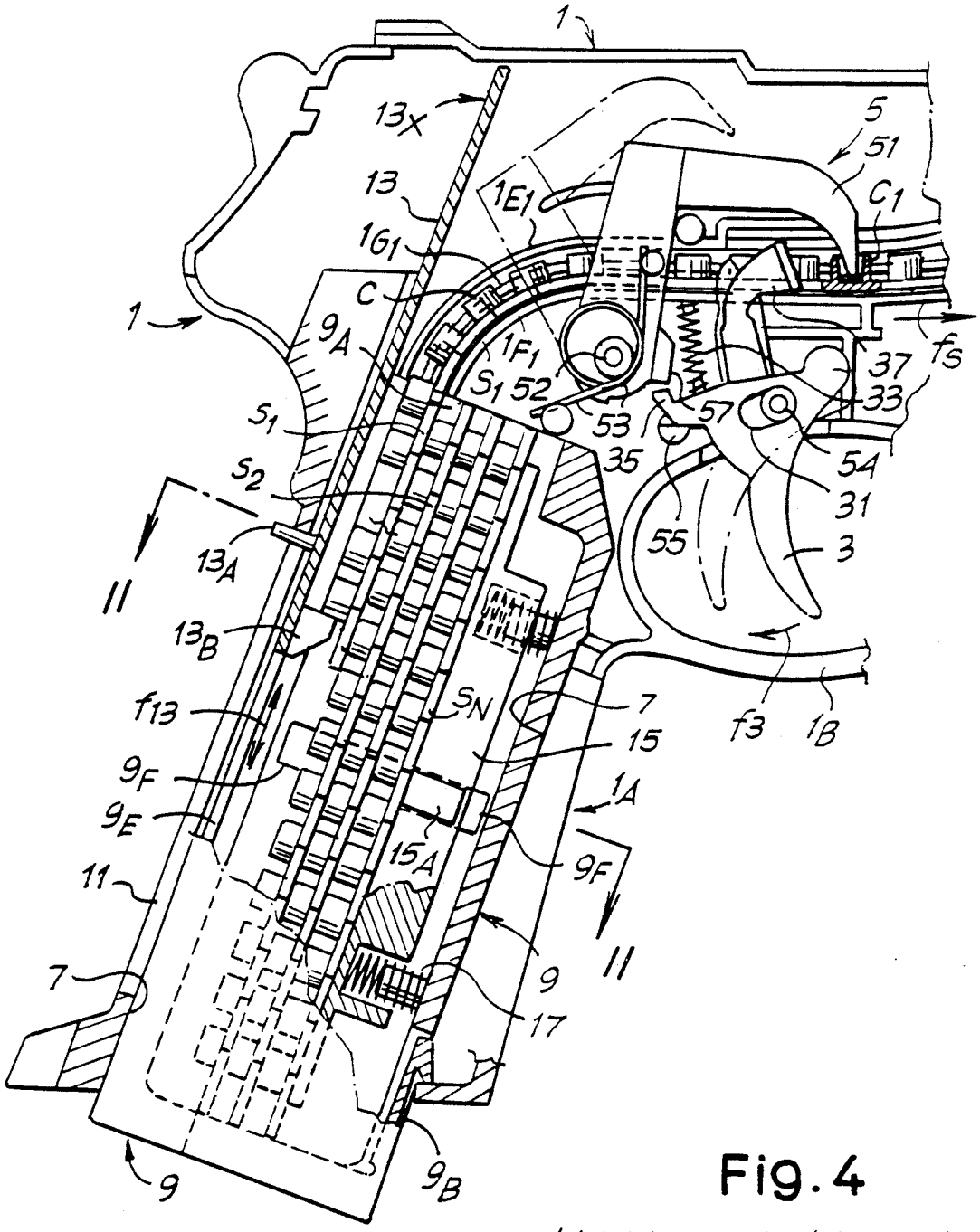
FIG. 3 shows an enlarged cutaway view of FIG. 1 with some parts in a different position.

At its lower end when looking at FIG. 1 the slider 13 is provided with an inner tooth 13B able to engage the strip ammunition which is adjacent to said slider, that is to say the one indicated by S1 in the drawing. By moving the slider 13 upwards (looking at FIGS. 1 and 3) the strip ammunition S1 can be made to slide in the same direction in order to draw it out from the magazine and insert it into the arm guide. The ridges 1E, 1F, 1G start in correspondence of the strip in position S1 adjacent to the opening 9A of the magazine when the latter is inserted in the pistol. The ridges 1E, 1F, 1G have first curved portions clearly shown in the drawing at 1E1, 1F1 and 1G1. These first portions match with longitudinal portions 1E, 1F, 1G which define the region of the sliding seat for the strip ammunition. The strip ammunition moves along said sliding seat in order to place each subsequent firing charge into position C1 each time the trigger is acted upon.

When a strip must be inserted from position S1 up to the sliding seat of the arm, the strip is made to slide within the sliding seat formed by the ridges 1E1, 1F1, 1G1, and 1E, 1F, 1G up to the elastic feeding side tooth 37 by acting on projection 13A. The tooth 37 is thus able to engage the first tooth D of the strip. The stroke of slider 13 inwardly of the arm is defined both by the lenght of slot 11 possibly also by the rigid strip portion of slider 13, which may reach a stop position against the case 1 of the arm. This position is indicated by 13X in the drawing. When the slider reaches the position defined by the above mentioned stop and/or by the bottom of slot 11, the elastic side tooth 37 becomes safely snap engaged with one tooth D of the ammunition. In this way the successive and intermittent advancement of the ammunition is ensured.

The strips of ammunition S1, S2, Sn are inserted from the upper opening 9A into the magazine when this is withdrawn from the arm. The various strips are pushed within the magazine towards the slider 13 by a pusher 15 which is urged by springs 17 suitably guided into dead holes of the pusher 15 and by pegs projecting from the case of the magazine 9. The pusher 15 is manually retracted against the action of springs 17 by acting on the tongues 15A, which can be reached through transverse slots 9F of the magazine 9, to successively insert the various ammunition strips S1, S2, Sn. By releasing the tongues 15A the pusher 15 ensures the abutment of the ammunition strips one against the other and towards the slider 13, so that the tooth 13B of this slider may pick up the strip ammunition which is closer to said slider, to insert it into the above defined sliding seat 1E1, 1F1, 1G1 of the arm and feed it to the successive firing positions.

It will be appreciated that the magazine may be withdrawn from the seat 7 of the butt or handle of the arm and may be reused by inserting the ammunition strips therein.

Although the magazine is relatively cumbersome, it does not affect the design and shaping of the toy arm as it is housed within the butt or handle 1A of the arm, while the firing charges are easily fed to the automatic loading and percussion region through the arcuate sliding guides.

I claim:

1. A toy fire-arm comprising a hollow, butt-shaped handle connected to a trigger and barrel assembly, including percussion means for firing strip ammunition fed thereto, said handle having a seat 7 for receiving and supporting a magazine therein, a magazine insertable in said handle against said seat (7), said magazine including means for supporting strip ammunition (S) arranged side-by-side, including means for maintaining said plurality of strips (S) against one side of said magazine to enable the sequential feeding of each of said strips from said magazine to and through strip guide means to said trigger and barrel assembly, and a slider means 13 disposed along said one side of said magazine for slidingly feeding strip ammunition containing firing charges C1 from said magazine in steps through said guide means to said trigger and firing assembly, for firing by said percussion means.

2. The toy fire-arm as in claim 1, wherein said slider means 13 has means associated therewith for manually actuating said slider 13 for feeding said strip ammunition containing firing charges C to said percussion means.

3. The toy fire-arm as in claim 2, wherein said manual actuating means is a projection 13A which extends out of the handle and slides along a slot in said handle during feeding of strip ammunition to said strip guide means.

4. The toy fire-arm as in claim 2, wherein the means for maintaining the plurality of strips against said one side of said magazine comprises a pusher element 15 cooperatively associated with said magazine for elastically applying a force against said plurality of strip.

5. The toy fire-arm as in claim 4, wherein said pusher element 15 is spring-mounted for elastically applying force to said plurality of strips.

6. The toy fire-arm as in claim 1, wherein said strip guide means includes elements 1E1, 1F1, 1G1, 1E, 1F and 1G cooperatively associated with magazine and butt-shaped handle said strip guide means 1E1, 1F1, 1G1 providing a curved pathway in communication with strip guide means 1E, 1F and 1G, respectively, said strip guide means 1E, 1F and 1G being cooperatively associated with said trigger and barrel assembly for feeding strip ammunition to said percussion means.

* * * * *